US011391107B2

(12) United States Patent
Al-Mousa et al.

(10) Patent No.: US 11,391,107 B2
(45) Date of Patent: Jul. 19, 2022

(54) FLUID MANAGEMENT SYSTEMS AND RELATED METHODS OF CONTROLLING FLUID FLOW IN OIL AND GAS APPLICATIONS

(71) Applicant: Saudi Arabian Oil Company, Dhahran (SA)

(72) Inventors: Ahmed Al-Mousa, Dhahran (SA); Marius Neacsu, Dhahran (SA); Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 273 days.

(21) Appl. No.: 16/775,765

(22) Filed: Jan. 29, 2020

(65) Prior Publication Data

US 2021/0230960 A1 Jul. 29, 2021

(51) Int. Cl.

| | |
|---|---|
| ***E21B 43/12*** | (2006.01) |
| ***E21B 33/06*** | (2006.01) |
| ***E21B 17/00*** | (2006.01) |

(52) U.S. Cl.

CPC ..... *E21B 33/061* (2013.01); *E21B 17/006* (2013.01); *E21B 43/12* (2013.01)

(58) Field of Classification Search

USPC ..... 251/1.3

See application file for complete search history.

(56) References Cited

U.S. PATENT DOCUMENTS

| | | | | |
|---|---|---|---|---|
| 4,325,534 | A * | 4/1982 | Roark | E21B 33/062 251/1.3 |
| 4,413,642 | A | 11/1983 | Smith et al. | |
| 4,467,996 | A * | 8/1984 | Baugh | E21B 33/062 251/1.3 |
| 5,505,426 | A * | 4/1996 | Whitby | E21B 33/063 251/1.3 |
| 5,875,841 | A | 3/1999 | Wright et al. | |
| 7,000,888 | B2 * | 2/2006 | Wright | E21B 19/12 251/1.3 |
| 7,374,146 | B2 * | 5/2008 | Whitby | E21B 33/062 166/85.4 |
| 8,376,051 | B2 | 2/2013 | McGrath et al. | |
| 9,551,200 | B2 | 1/2017 | Read et al. | |
| 2004/0031940 | A1 | 2/2004 | Biester | |
| 2009/0194290 | A1 | 8/2009 | Parks et al. | |
| 2017/0058628 | A1 | 3/2017 | Wijk et al. | |
| 2019/0049017 | A1 | 2/2019 | McAdam et al. | |

OTHER PUBLICATIONS

PCT International Search Report and Written Opinion in International Appln. No. PCT/US2021/015219, dated Apr. 15, 2021, 13 pages.

* cited by examiner

*Primary Examiner* — Matthew Troutman
*Assistant Examiner* — Douglas S Wood
(74) *Attorney, Agent, or Firm* — Fish & Richardson P.C.

(57) ABSTRACT

A fluid management system for controlling fluid flow at a wellbore includes a closing element formed complementary to a drill pipe disposed within the wellbore and an activation system. The activation system is configured to move the closing element into an activated position against the drill pipe to close the wellbore around the drill pipe for preventing fluid from flowing out of the wellbore. The activation system includes an activation shaft coupled to the closing element and a rotatable drive shaft configured to cause translation of the activation shaft to push the closing element into the activated position against the drill pipe.

16 Claims, 5 Drawing Sheets

FLUID MANAGEMENT SYSTEMS AND RELATED METHODS OF CONTROLLING FLUID FLOW IN OIL AND GAS APPLICATIONS

TECHNICAL FIELD

This disclosure relates to fluid management systems, such as blowout preventers, and related methods of controlling fluid flow at a wellbore.

BACKGROUND

During certain operations performed at a wellbore, formation fluid within an annular region that surrounds a pipe of a tubing string disposed within the wellbore may begin to flow uncontrollably in an uphole direction, thereby posing the risk of a blowout of the wellbore. Blowout preventers are designed to seal around a pipe during wellbore control situations in order to contain the pressure of the formation fluid within the wellbore and therefore avoid uncontrolled flow of the formation fluid from the wellbore. However, in some cases, a blowout preventer may fail to activate (for example, fail to close the wellbore) due to any number of system failures. In such situations, the safety of a rig at the wellbore is significantly compromised.

SUMMARY

This disclosure relates to a blowout preventer including a mechanical activation system that is operable to close a pipe ram assembly around a drill pipe disposed within a wellbore to prevent uncontrolled, uphole-directed fluid flow from the wellbore around the drill pipe. The mechanical activation system is a contingency system that can be utilized in case a primary hydraulic activation system of the blowout preventer fails to close two cooperating pipe ram blocks of the pipe ram assembly around the drill pipe for any reason. For each pipe ram block, the mechanical activation system includes an activation shaft that is coupled to the pipe ram block and translatable to move the pipe ram block linearly, a drive shaft that is coupled to the activation shaft and rotatable to cause translation of the activation shaft along the drive shaft, a drive loop that is translatable along the drive shaft to rotate the drive shaft, and a pneumatic motor that is operable to activate the drive loop.

The drive shaft has a threaded exterior profile by which the drive loop engages the drive shaft to rotate the drive shaft. The threaded exterior profile of the drive shaft also engages a threaded interior profile of the activation shaft that causes the activation shaft to translate as the drive shaft rotates. Inwardly directed translation of the activation shafts causes the pipe ram blocks to close against each other around the drill pipe, whereas outwardly directed translation of the activation shafts causes the pipe ram blocks to move away from each other and from the drill pipe.

In one aspect, a fluid management system for controlling fluid flow at a wellbore includes a closing element formed complementary to a drill pipe disposed within the wellbore and an activation system. The activation system is configured to move the closing element into an activated position against the drill pipe to close the wellbore around the drill pipe for preventing fluid from flowing out of the wellbore. The activation system includes an activation shaft coupled to the closing element and a rotatable drive shaft configured to cause translation of the activation shaft to push the closing element into the activated position against the drill pipe.

Embodiments may provide one or more of the following features.

In some embodiments, the fluid management system further includes a drive loop coupled to the rotatable drive shaft and a pneumatic motor that controls the drive loop.

In some embodiments, the rotatable drive shaft is rotatable in a first direction to move the closing element into the activated position.

In some embodiments, the rotatable drive shaft is rotatable in a second direction to allow the closing element to move from the activated position to a deactivated position that is spaced apart from the drill pipe to expose the wellbore around the drill pipe, and the second direction is opposite to the first direction.

In some embodiments, the activation shaft includes an interior threaded profile, and the rotatable drive shaft includes an exterior threaded profile that is formed to engage the interior threaded profile of the activation shaft.

In some embodiments, interior threaded profile and the exterior threaded profile include square threads.

In some embodiments, the closing element is a first closing element, the activation shaft is a first activation shaft, the rotatable drive shaft is a first rotatable drive shaft, the activated position is a first activated position, the fluid management system further includes a second closing element that is configured to cooperate with the first closing element to close the wellbore around the drill pipe, and the activation system further includes a second activation shaft coupled to the second closing element and a second rotatable drive shaft configured to cause translation of the second activation shaft to push the second closing element into a second activated position against the drill pipe.

In some embodiments, the closing element includes a pipe ram block.

In some embodiments, the activation system includes a contingency activation system, and the fluid management system further includes a hydraulic activation system that is configured to move the closing element into the activated position against the drill pipe to close the wellbore around the drill pipe for preventing the fluid from flowing out of the wellbore.

In some embodiments, the fluid management system is configured to operate the contingency activation system to move the closing element into the activated position against the drill pipe upon failure of the hydraulic activation system.

In another aspect, a method of controlling fluid flow at a wellbore includes providing a closing element of a fluid management system at the wellbore, the closing element being formed complementary to a drill pipe disposed within the wellbore. The method further includes rotating a drive shaft of an activation system of the fluid management system and translating an activation shaft of the activation system, the activation shaft being coupled to the drive shaft and to the closing element. The method further includes pushing the closing element into an activated position against the drill pipe to close the wellbore around the drill pipe for preventing fluid from flowing out of the wellbore.

Embodiments may provide one or more of the following features.

In some embodiments, the method further includes operating a pneumatic motor of the activation system to activate a drive loop of the activation system, the drive loop being coupled to the drive shaft.

In some embodiments, the method further includes rotating the drive shaft in a first direction to move the closing element into the activated position.

In some embodiments, the method further includes rotating the drive shaft in a second direction to allow the closing element to move from the activated position to a deactivated position that is spaced apart from the drill pipe to expose the wellbore around the drill pipe, wherein the second direction is opposite to the first direction.

In some embodiments, the activation shaft includes an interior threaded profile, and the drive shaft includes an exterior threaded profile that is formed to engage the interior threaded profile of the activation shaft.

In some embodiments, the interior threaded profile and the exterior threaded profile include square threads.

In some embodiments, the closing element is a first closing element, the activation shaft is a first activation shaft, the drive shaft is a first drive shaft, the activated position is a first activated position, and the method further includes providing a second closing element of the fluid management system, the second closing element being configured to cooperate with the first closing element to close the wellbore around the drill pipe. The method further includes rotating a second drive shaft of the activation system, translating a second activation shaft of the activation system, the second activation shaft being coupled to the second drive shaft and to the second closing element, and pushing the second closing element into a second activated position against the drill pipe to close the wellbore around the drill pipe for preventing fluid from flowing out of the wellbore In some embodiments, the closing element includes a pipe ram block.

In some embodiments, the activation system is a contingency activation system, and the fluid management system further includes a hydraulic activation system that is configured to move the closing element into the activated position against the drill pipe to close the wellbore around the drill pipe for preventing the fluid from flowing out of the wellbore.

In some embodiments, the method further includes determining a failure of the hydraulic activation system and operating the contingency activation system to move the closing element into the activated position against the drill pipe upon failure of the hydraulic activation system.

The details of one or more embodiments are set forth in the accompanying drawings and description. Other features, aspects, and advantages of the embodiments will become apparent from the description, drawings, and claims.

DETAILED DESCRIPTION

Figure 1:
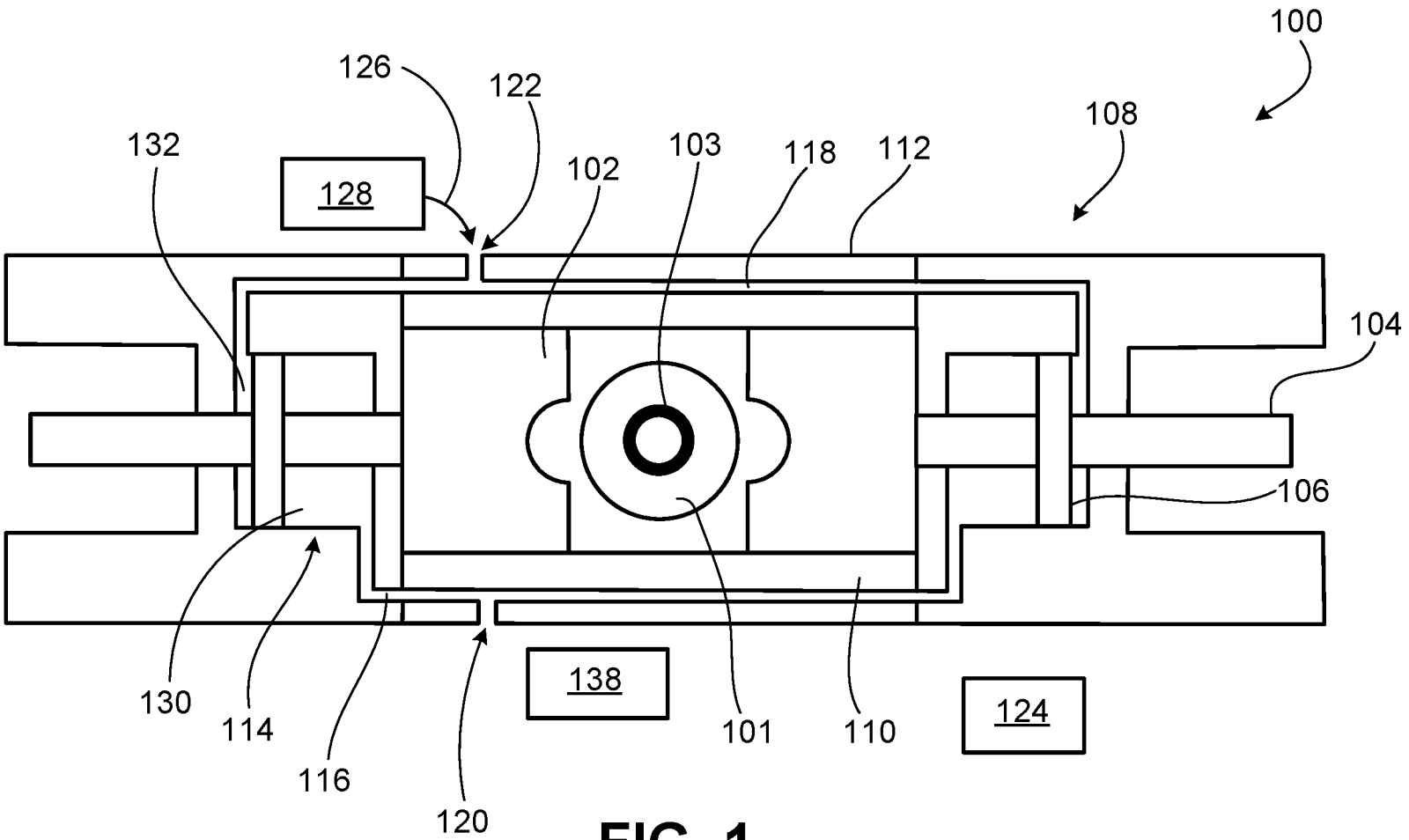
FIG. 1 is a top view of a portion of an example fluid management system in a deactivated state.
Figure 2:
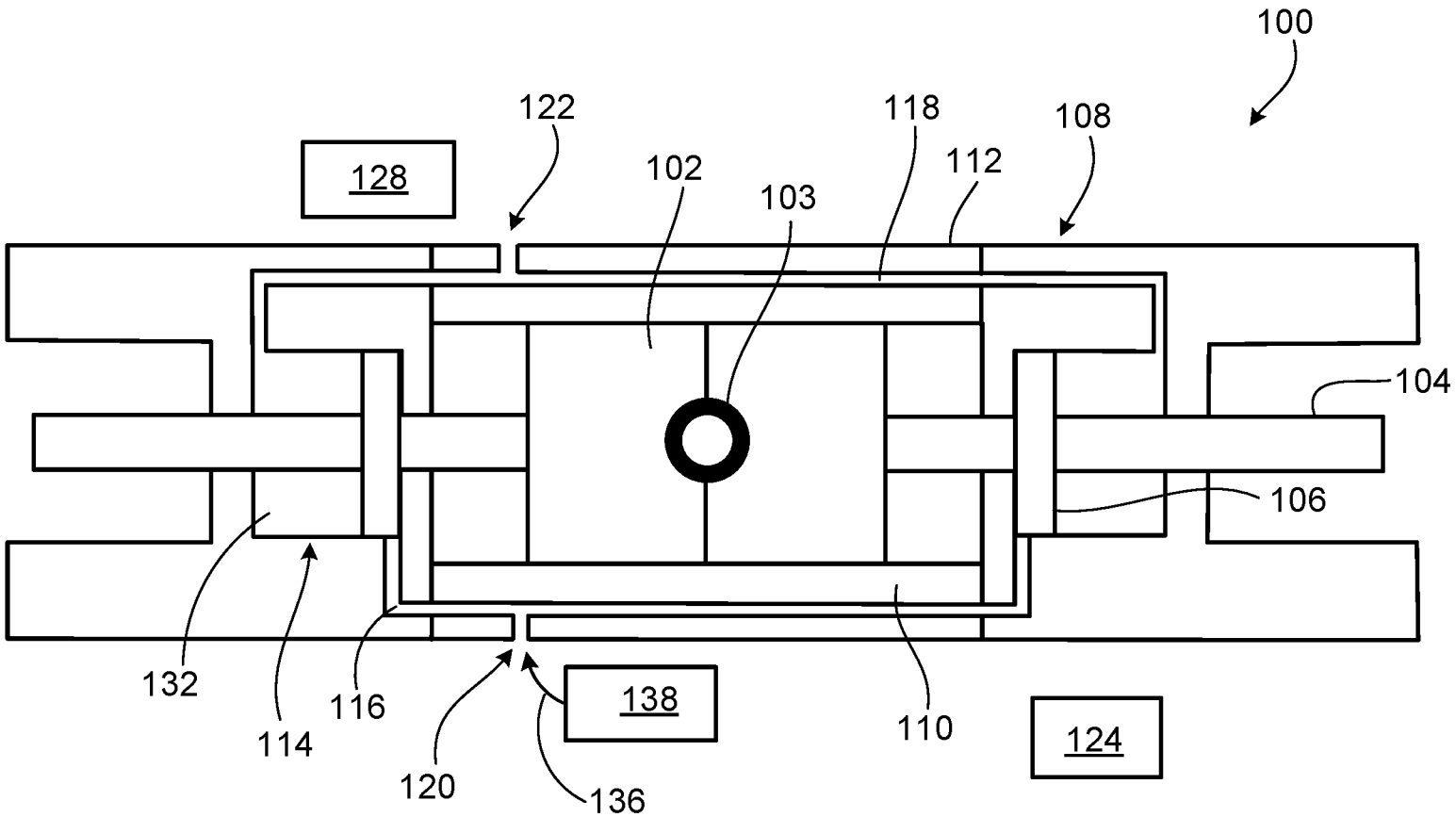
FIG. 2 is a top view of the portion of the fluid management system of FIG. 1 in an activated state.

FIGS. 1 and 2 illustrate a portion of a fluid management system 100 (for example, an annular blowout preventer) that is operable to close a wellbore 101 around a drill pipe 103 disposed within the wellbore 101. In some instances, formation fluid within the wellbore 101 may begin to flow uncontrollably in an uphole direction around the drill pipe 103, thereby posing the risk of a blowout of the wellbore 101. The fluid management system 100 is designed to close against an exterior surface of the drill pipe 103 to prevent formation fluid within the wellbore 101 from spewing uncontrollably out of the wellbore 101 in such instances. In this manner, the fluid management system 100 is designed to isolate a pressure of the formation fluid within the wellbore 101 to prevent uncontrolled, uphole-directed fluid flow from the wellbore 101. In some embodiments, the fluid management system 100 is an onshore blowout preventer positioned above ground and above a wellhead. In some embodiments, the fluid management system 100 is an offshore blowout preventer for a jack-up rig and positioned above a wellhead on a producing platform above sea level.

The fluid management system 100 includes two pipe ram blocks 102 (for example, blind ram blocks) that are formed to seal against the exterior surface of the drill pipe 103, two rods 104 that extend respectively from the pipe ram blocks 102, two pistons 106 that are carried respectively by the rods 104, and a surrounding housing 108. The fluid management system 100 is configured such that the rods 104 can be shifted linearly to move the pipe ram blocks 102 between an open, deactivated position (as shown in FIG. 1) and a closed, activated position (as shown in FIG. 2). The housing 108 includes an interior housing 110 that surrounds the pipe ram blocks 102 and an exterior housing 112 that, together with the interior housing 110, forms two hydraulic fluid chambers 114 around the pistons 106. Together, the interior and exterior housings 110, 112 also form an inner fluid channel 116 that fluidically communicates with inner regions 130 of the fluid chambers 114 and an outer fluid channel 118 that fluidically communicates with outer regions 132 of the fluid chambers 114. The exterior housing 112 defines an opening fluid port 120 that is fluidically connected to the inner fluid channel 116 and a closing fluid port 122 that is fluidically connected to the outer fluid channel 118.

The housings 110 and 112, the fluid ports 120 and 122, the fluid channels 118 and 120, and the fluid chambers 114 together form a primary activation system 134 (for example, a hydraulic activation system) of the fluid management system 100 for closing the pipe ram blocks 102 against the drill pipe 103 to prevent formation fluid from flowing out of the wellbore 101 in an uphole direction. The primary activation system 134 is also operable to subsequently release the pipe ram blocks 102 from the drill pipe 103 to expose (for example, to open) the wellbore 101. For example, according to one or more signals received from a control system 124, hydraulic fluid can be delivered (refer to arrow 126) from a fluid receptacle 128 to the fluid port 122, where such hydraulic fluid flows to the outer regions 132 of the fluid chambers 114 and pushes the pistons 106 inwardly, as shown in FIG. 2. The rods 104, attached to the pistons 106, force (for example, push) the pipe ram blocks 102 closed against the drill pipe 103 to isolate the wellbore 101, while any hydraulic fluid that was present within the inner regions 130 of the fluid chambers 114 is forced out of the fluid chambers 114 through the inner fluid channel 116 and the opening fluid port 120 into a fluid receptacle 138.

The primary activation system 134 is also operable, according to one or more signals received from the control system 124, to release the pipe ram blocks 102 from the drill pipe 103. For example, hydraulic fluid can be delivered (refer to arrow 136) from the fluid receptacle 138 to the fluid port 120, where such hydraulic fluid flows to the inner regions 130 of the fluid chambers 114 and pushes the pistons 106 outwardly, as shown in FIG. 1. The rods 104, attached to the pistons 106, force (for example, pull) the pipe ram blocks 102 away from the drill pipe 103 to expose the wellbore 101, while any hydraulic fluid that was present within the outer regions 132 of the fluid chambers 114 is forced out of the fluid chambers 114 through the outer fluid channel 118 and the closing fluid port 122 into the fluid receptacle 128.

In case the primary activation system 134 of the fluid management system 100 fails to close the pipe ram blocks 102 against the drill pipe 103 for any reason, the fluid management system 100 further includes a secondary activation system 140 (for example, a mechanical activation system) that is operable as a backup, contingency measure to close the pipe ram blocks 102 against the drill pipe 103 to prevent formation fluid from flowing out of the wellbore 101 in an uphole direction. The secondary activation system 140 is also operable to subsequently release the pipe ram blocks 102 from the drill pipe 103 to expose the wellbore 101. In some examples, the primary activation system 134 may fail due to a leak in one or both of the fluid channels 116, 118 or other hydraulic control lines. In some examples, the primary activation system 134 may fail due to a breakdown of one or more hydraulic control features.

Figure 3:
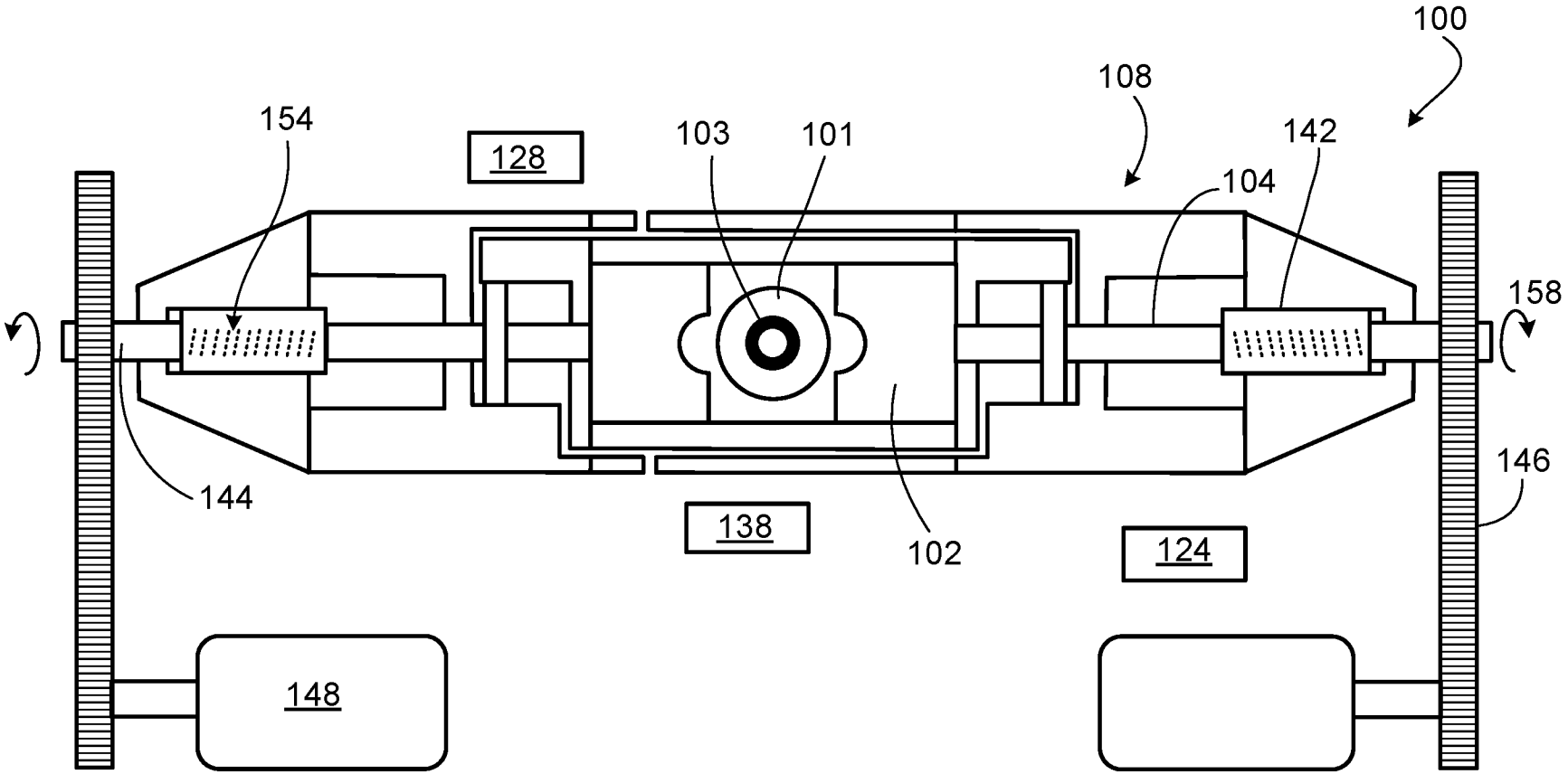
FIG. 3 is a top view of the fluid management system of FIG. 1 in the deactivated state.
Figure 4:
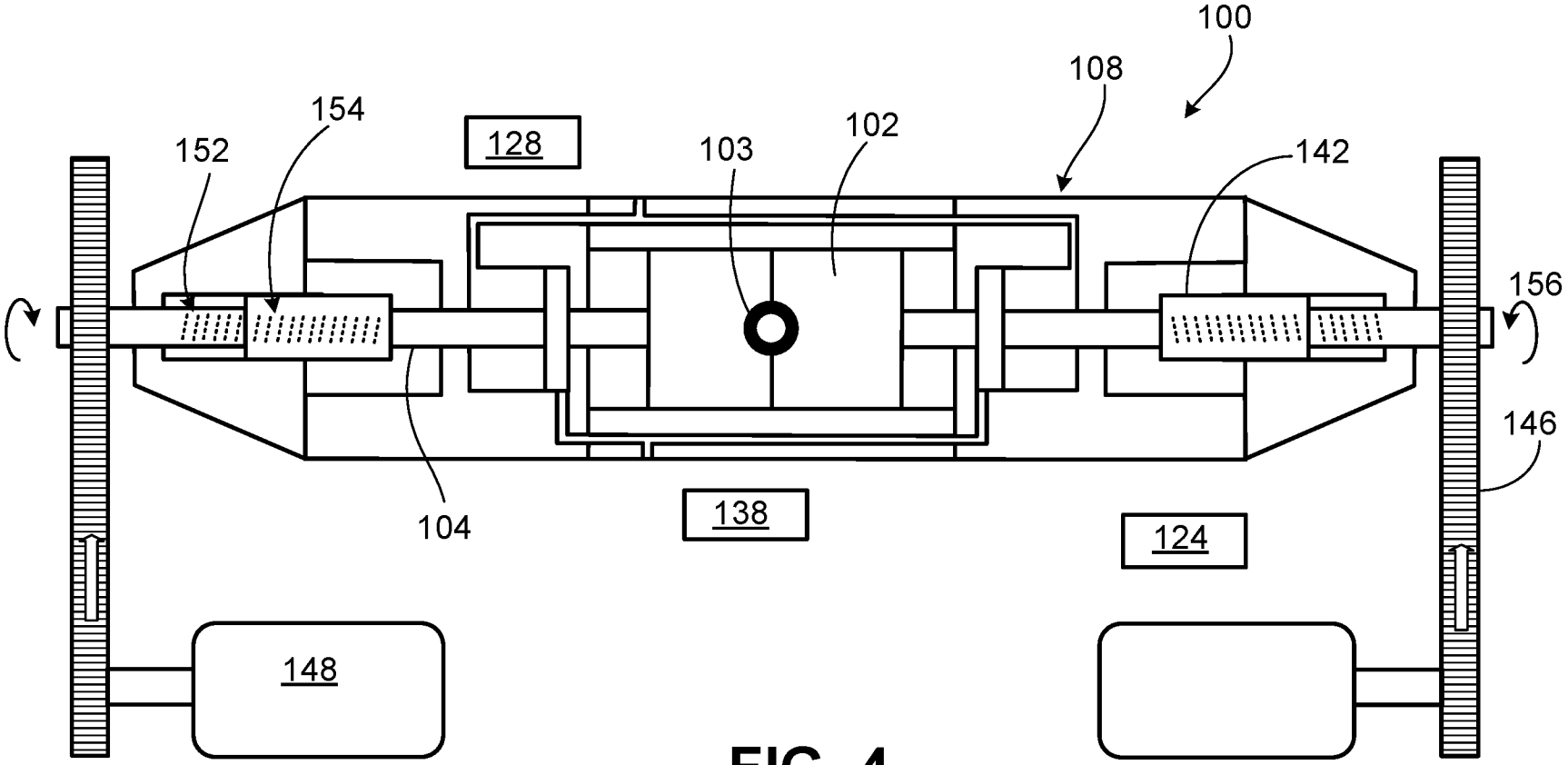
FIG. 4 is a top view of the fluid management system of FIG. 1 in the activated state.

In this regard, and referring to FIGS. 3 and 4, the fluid management system 100 further includes two activation shafts 142 that are respectively connected to outer ends of the rods 104 for translating the rods 104, two drive shafts 144 that are coupled to the activation shafts 142 and rotatable to cause translation of the activation shafts 142 along the drive shafts 144, two gears and drive loops 146 that are translatable respectively along the drive shafts 144 to rotate the drive shafts 144, and two pneumatic motors 148 that are operable to activate rotation of the drive loops 146 for translation along the drive shafts 144. In some embodiments, the drive loops 146 may be provided as drive belts. In some embodiments, the drive loops 146 may be provided as drive chains.

The drive shafts 144 have threaded exterior profiles 152 by which the drive loops 146 engage the drive shafts 144 to rotate the drive shafts 144. The threaded exterior profiles 152 of the drive shafts 144 also engage respective threaded interior profiles 154 of the activation shafts 142 that causes the activation shafts 142 to translate as the drive shafts 144 rotate. In some embodiments, the exterior and interior threaded profiles 152, 154 are provided as square threads. Use of such square threads in the fluid management system 100 has several advantages over other forms of threads. For example, as compared to other types of threads, square threads have better transmission efficiency due to less friction, allow for high efficiency due to a profile angle of zero, transmit power without any side thrust in either direction, and are designed for power screw designs. The exterior housing 112 defines two channels 150 around the activation shafts 142 that respectively ensure smooth linear movements of the activation shafts 142 along the drive shafts 144.

Rotation of the drive shafts 144 in a first rotational direction 156 results in inwardly directed translation of the activation shafts 142 to cause the pipe ram blocks 102 to close against each other around the drill pipe 103 to prevent formation fluid from flowing out of the wellbore 101. In contrast, rotation of the drive shafts 144 in a second, opposite rotational direction 158 results in outwardly directed translation of the activation shafts 142 to cause the pipe ram blocks 102 to move away from each other and from the drill pipe 103. For example, once the fluid flow of the wellbore 101 is put under control and the primary activation system 134 is repaired, the drive shafts 144 are rotated in the second rotational direction 158 to relieve the inwardly directed force from the pipe ram blocks 102 to allow the pipe ram blocks 102 to move back to the open position under hydraulic action of the primary activation system 134.

In some embodiments, the difference (for example, a length of travel) between a fully deactivated position of an activation shaft 142 (as shown in FIG. 3) and a fully activated position of the same activation shaft 142 (as shown in FIG. 4) is a distance of about 0.09 meters (m) to about 0.27 m. In some embodiments, the activation shafts 142 and the drive shafts 144 are made of one or more materials, such as steel, that are resistant to corrosion, that can withstand high compressive loads, and that can withstand high torque loads.

The exterior housing 112, the pneumatic motors 148, the drive loops 146, the drive shafts 144, and the activation shafts 142 together form the secondary activation system 140 of the fluid management system 100 for closing the pipe ram blocks 102 against the drill pipe 103 to prevent formation fluid from flowing out of the wellbore 101 in an uncontrolled manner. The pneumatic motors 148 can be activated manually or according to one or more signals received from the control system 124 in a safe manner near the wellbore 101 without causing undesirable ignition of hydrocarbon oil or gas in the event of uncontrolled fluid flow or fluid leak. In some embodiments, components of the secondary activation system 140 may be installed to a fluid management system that is substantially similar in construction and function to the fluid management system 100, but that does not initially include any contingency well closure mechanism.

Figure 5:
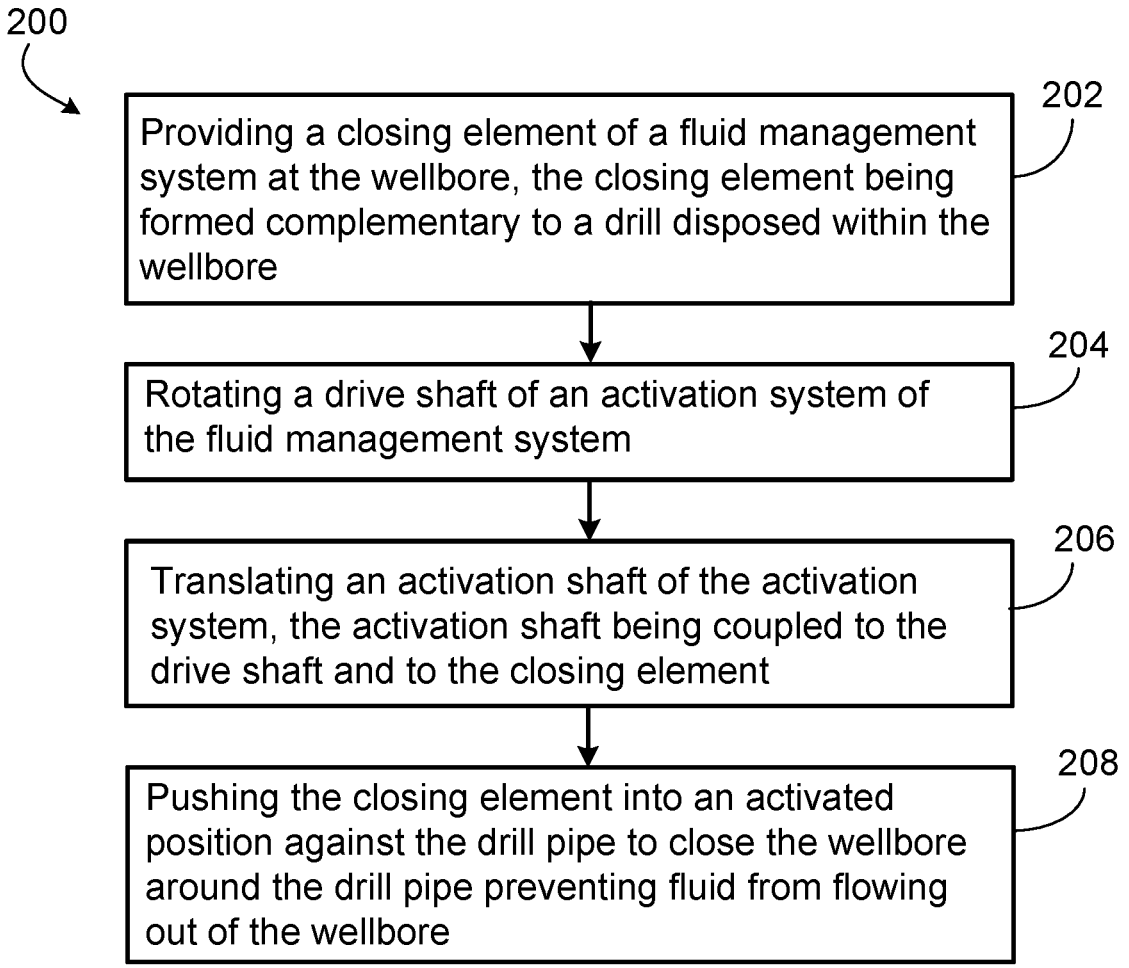
FIG. 5 is a flow chart illustrating an example method of controlling fluid flow at a wellbore using the fluid management system of FIG. 1.

FIG. 5 is a flow chart illustrating an example method 200 of controlling fluid flow at a wellbore (for example, the wellbore 101). In some embodiments, the method 200 includes providing a closing element (for example, a pipe ram block 102) of a fluid management system (for example, the fluid management system 100) at the wellbore, the closing element being formed complementary to a drill pipe (for example, the drill pipe 103) disposed within the wellbore (202). In some embodiments, the method 200 further includes rotating a drive shaft (for example, the drive shaft 144) of an activation system (for example, the secondary activation system 140) of the fluid management system (204). In some embodiments, the method 200 further includes translating an activation shaft (for example, the activation shaft 142) of the activation system, the activation shaft being coupled to the drive shaft and to the closing element (206). In some embodiments, the method 200 further includes pushing the closing element into an activated position against the drill pipe to close the wellbore around the drill pipe for preventing fluid from flowing out of the wellbore (208).

While the fluid management system 100 has been described and illustrated with respect to certain dimensions, sizes, shapes, arrangements, materials, and methods 200, in some embodiments, a fluid management system that is otherwise substantially similar in construction and function to the fluid management system 100 may include one or more different dimensions, sizes, shapes, arrangements, and materials or may be utilized according to different methods.

Accordingly, other embodiments are also within the scope of the following claims.

What is claimed is:

1. A fluid management system for controlling fluid flow at a wellbore, the fluid management system comprising:

a closing element formed complementary to a drill pipe disposed within the wellbore;

an activation system configured to move the closing element into an activated position against the drill pipe to close the wellbore around the drill pipe for preventing fluid from flowing out of the wellbore, the activation system comprising:

an activation shaft coupled to the closing element and comprising an interior threaded profile, and a rotatable drive shaft configured to cause translation of the activation shaft to push the closing element into the activated position against the drill pipe and comprising an exterior threaded profile that is formed to engage the interior threaded profile of the activation shaft, wherein the interior threaded profile and the exterior threaded profile comprise square threads with a profile angle of zero and that are configured to transmit power substantially without side thrust.

2. The fluid management system of claim 1, further comprising:

a drive loop coupled to the rotatable drive shaft; and a pneumatic motor that controls the drive loop.

3. The fluid management system of claim 1, wherein the rotatable drive shaft is rotatable in a first direction to move the closing element into the activated position.

4. The fluid management system of claim 3, wherein the rotatable drive shaft is rotatable in a second direction to allow the closing element to move from the activated position to a deactivated position that is spaced apart from the drill pipe to expose the wellbore around the drill pipe, and wherein the second direction is opposite to the first direction.

5. The fluid management system of claim 1, wherein the closing element is a first closing element, the activation shaft is a first activation shaft, the rotatable drive shaft is a first rotatable drive shaft, and the activated position is a first activated position, wherein the fluid management system further comprises a second closing element that is configured to cooperate with the first closing element to close the wellbore around the drill pipe, and wherein the activation system further comprises:

a second activation shaft coupled to the second closing element, and a second rotatable drive shaft configured to cause translation of the second activation shaft to push the second closing element into a second activated position against the drill pipe.

6. The fluid management system of claim 1, wherein the closing element comprises a pipe ram block.

7. The fluid management system of claim 1, wherein the activation system comprises a contingency activation system, and wherein the fluid management system further comprises a hydraulic activation system that is configured to move the closing element into the activated position against the drill pipe to close the wellbore around the drill pipe for preventing the fluid from flowing out of the wellbore.

8. The fluid management system of claim 7, wherein the fluid management system is configured to operate the contingency activation system to move the closing element into the activated position against the drill pipe upon failure of the hydraulic activation system.

9. A method of controlling fluid flow at a wellbore, the method comprising:

providing a closing element of a fluid management system at the wellbore, the closing element being formed complementary to a drill pipe disposed within the wellbore;

rotating a drive shaft of an activation system of the fluid management system;

translating an activation shaft of the activation system, the activation shaft being coupled to the drive shaft and to the closing element; and pushing the closing element into an activated position against the drill pipe to close the wellbore around the drill pipe for preventing fluid from flowing out of the wellbore, wherein the activation shaft comprises an interior threaded profile, wherein the drive shaft comprises an exterior threaded profile that is formed to engage the interior threaded profile of the activation shaft, and wherein the interior threaded profile and the exterior threaded profile comprise square threads with a profile angle of zero and that are configured to transmit power substantially without side thrust.

10. The method of claim 9, further comprising operating a pneumatic motor of the activation system to activate a drive loop of the activation system, the drive loop being coupled to the drive shaft.

11. The method of claim 9, further comprising rotating the drive shaft in a first direction to move the closing element into the activated position.

12. The method of claim 11, further comprising rotating the drive shaft in a second direction to allow the closing element to move from the activated position to a deactivated position that is spaced apart from the drill pipe to expose the wellbore around the drill pipe, wherein the second direction is opposite to the first direction.

13. The method of claim 9, wherein the closing element is a first closing element, the activation shaft is a first activation shaft, the drive shaft is a first drive shaft, and the activated position is a first activated position, wherein the method further comprises:

providing a second closing element of the fluid management system, the second closing element being configured to cooperate with the first closing element to close the wellbore around the drill pipe;

rotating a second drive shaft of the activation system;

translating a second activation shaft of the activation system, the second activation shaft being coupled to the second drive shaft and to the second closing element; and pushing the second closing element into a second activated position against the drill pipe to close the wellbore around the drill pipe for preventing fluid from flowing out of the wellbore.

14. The method of claim 9, wherein the closing element comprises a pipe ram block.

15. The method of claim 9, wherein the activation system comprises a contingency activation system, and wherein the fluid management system further comprises a hydraulic activation system that is configured to move the closing element into the activated position against the drill pipe to close the wellbore around the drill pipe for preventing the fluid from flowing out of the wellbore.

16. The method of claim 15, further comprising:

determining a failure of the hydraulic activation system; and operating the contingency activation system to move the closing element into the activated position against the drill pipe upon failure of the hydraulic activation system.

* * * * *